United States Patent [19]

Zimmerman

[11] Patent Number: 4,570,398

[45] Date of Patent: Feb. 18, 1986

[54] SPRAYED CONCRETE BASEMENT STRUCTURE

[75] Inventor: Melvin M. Zimmerman, Blue Ball, Pa.

[73] Assignee: Superior Walls, East Earl, Pa.

[21] Appl. No.: 585,410

[22] Filed: Mar. 2, 1984

[51] Int. Cl.[4] ..... E02D 19/00

[52] U.S. Cl. ..... 52/169.11; 52/169.14; 52/309.12; 52/393

[58] Field of Search ..... 52/169.11, 169.14, 309.9, 52/309.12, 309.14, 309.17, 404, 293, 294

[56] References Cited

U.S. PATENT DOCUMENTS 2,835,126 5/1958 Paolella ..... 52/169.14
3,798,852 3/1974 Nicoll ..... 52/293 X
4,353,194 10/1982 Norton ..... 52/293

FOREIGN PATENT DOCUMENTS 970582 7/1975 Canada ..... 52/169.11
535349 4/1941 United Kingdom ..... 52/169.14

*Primary Examiner*—J. Karl Bell
*Attorney, Agent, or Firm*—Martin Fruitman

[57] ABSTRACT

A new method of construction for building basements. Precast concrete studs are used to build the framework of the vertical walls of the basement, rigid sheet insulation is attached to the outside of the concrete studs, and wire mesh is attached to the sheet insulation. Concrete is then sprayed onto the insulation and wire to form a continuous waterproof outer surface.

28 Claims, 5 Drawing Figures

SPRAYED CONCRETE BASEMENT STRUCTURE

SUMMARY OF THE INVENTION

This invention deals generally with building construction and more specifically with the construction of basment walls.

The traditional methods of constructing building basements are well established. For commercial structures and for high volume residential developments with identical dimensions for each building, poured concrete is used. This involves the construction of forms, either wood or metal, in the exact shape of the vertical basement walls, and then pouring concrete into the forms. After the concrete hardens, the forms are removed and construction continues on the rest of the building.

The cost of forms limits this method to those buildings where the height requires the strength of reinforced concrete or where the reuse of forms for many identical structures located in the same general area permits the sharing of the costs of form construction by many buildings.

The more common basement construction technique is the straight forward construction of the vertical walls by laying many courses of cinder block, one on top of the other. This method is virtually the only one in use for isolated building sites or small developments, and it is both time consuming and labor intensive. There has been no way of avoiding the fact that each cinder block must be individually placed and surrounded by mortar, and while whole walls above ground can be prefabricated, no such economy has been available for basements. One need only watch a house being built to realize that the cinder block basement may take over a week to construct on a typical site, while the framing and exterior walls go up in just a day or so.

The present invention changes all that. The speed of construction of the basement of the preferred embodiment of the invention is no longer closely linked to the amount of manpower available, because the construction of a basement according to the invention is essentially a stud and sheath system.

The present invention permits the construction of a dry, strong, insulated basement with a limited work force in a relatively short time. Moreover, the labor cost is relatively unrelated to the size of the structure so that, for instance, a full height basement can be constructed with little additional cost or time compared to a lower height structure.

The key to the structure is the use of concrete studs for vertical height and strength, and the use of machine-sprayed concrete on the exterior wall for sealing and waterproofing.

The actual construction of such a basement involves the use of a unique precast concrete stud. Typically, this stud is two inches thick by six inches wide and eight feet high. It is cast in essentially rectangular cross section but can also contain a central narrower web to reduce weight and material cost. Steel reinforcing rods oriented along the length are cast into the studs to increase their strength, and several holes are formed in the central region to permit subsequent laying of electrical wires or water pipes through the studs within the walls that they form.

When the studs are cast, a pressure treated wood strip is cast onto one long, narrow edge, the edge which will eventually be the support of the interior basement wall, and fasteners, such as metal nails, are cast into the opposite edge, the edge which will hold the exterior surface. Moreover, two notches are cast into the ends of the studs for use in interlocking the studs with other components of the structure.

The studs are thereby specifically designed to match their anticipated use in a specific building system.

The actual construction of a basement starts with the laying of individual bricks spaced approximately 4 to 6 feet apart around the periphery of the base of the structure where adjustable and removeable leveling legs will be located. Upon these bricks is placed a pressure treated wood beam to which are attached adjustable legs protruding downward. This wooden beam is typically 2 inches by 4 inches in cross section. It is this base beam laid upon a crushed rock footing, upon which the rest of the structure is built.

Each precast concrete stud is then set onto the base beam so that its notch fits the base beam and its interior wood strip overlaps the base beam and is nailed to the base beam. The concrete studs are typically spaced on two foot centers and extend vertically upward eight feet where a top wooden stud fits into the top notch of each concrete stud. The interior wooden strip of each concrete stud is also nailed to the top wooden dubble plate, and ultimately the wooden top plate and the first floor's joists are also nailed to the dubble plate. The structure thus formed resembles the typical above-ground structure of a building, the major exception being that what appear, at least from the inside, to be wooden vertical studs are, in fact, reinforced concrete studs with a thin interior covering of wood strip cast onto their interior surfaces.

After the stud construction is completed, the exterior walls of the basement are constructed. This begins with the attachment to the exterior of the concrete studs of one or more layers of rigid sheath insulation. This is done by pushing the sheath insulation against the fasteners protruding from the concrete beams and impaling the sheath on those fasteners.

A layer of wire mesh is then attached over the entire surface outside of the insulation by bending the fasteners over the wires of the mesh to hold it in place, thus forming a two layer base of insulation and wire mesh upon which to spray concrete.

At this point the entire structure is leveled and plumbed by use of the adjustable legs attached to the base beam, and then the concrete is sprayed onto the outer surface of wire mesh at high velocity. The technique and machinery for this spraying is well known in the art of building, and it is applied to a one and one-half inch to two inch thickness. The sprayed concrete is also directed to cover the junction between the wall structure and the ground upon which the structure is built, so that an integrated watertight surface is formed from below the base beam to the top plate.

Finally, the concrete basement floor is poured on the inside so that it covers the concrete studs to a height of approximately three inches, thus further locking the structure in place.

A strong waterproof basement wall is thus formed with much less labor and in a far shorter time than by conventional construction techniques of laying cinder block. Moreover, the integral exterior surface is far less susceptible to water seepage and the wood strip cast onto the interior surface of each concrete stud permits the finishing of the interior walls by standard interior wall techniques, with none of the problems of attaching finishing materials to concrete or cinder block.

DETAILED DESCRIPTION OF THE INVENTION

Figure 1:
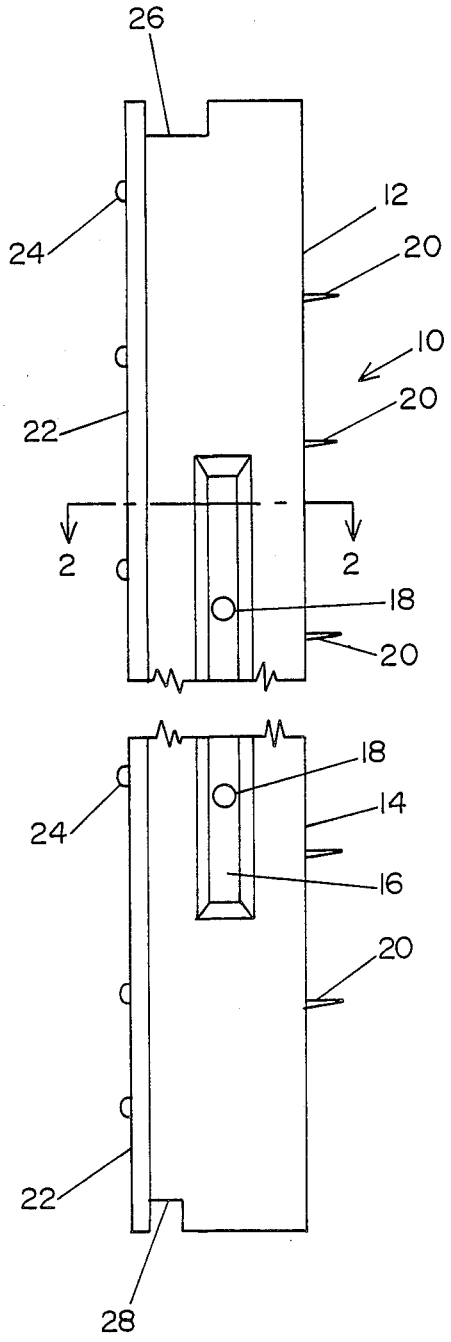
FIG. 1 is a side view of a typical reinforced concrete stud.

The preferred embodiment of the concrete stud of the invention is shown in FIG. 1 where concrete stud 10 is shown with a break in its length. Region 12 of stud 10 is cast with an essentially rectangular cross section, while region 14 is cast with thinner web 16 to reduce finished weight and decrease material costs. Holes 18 are cast into web 16 to provide passthrus for pipes and wires after the stud is built into a wall.

Fasteners 20, typically nails, protrude from one edge of concrete stud 10 into which they have been cast. Fasteners 20 are used to attach insulation and wire mesh to the exterior of the wall to be constructed with studs 10, as discussed below in reference to FIG. 4.

The other edge of concrete stud 10 has pressure treated wood strip 22 attached to it. The bond between concrete stud 10 and wood strip 22 is aided by fasteners 24 which were attached to wood strip 22 and protruded through it before concrete stud 10 was cast onto wood strip 22 and around fasteners 24.

Concrete stud 10 is also formed with notches 26 and 28 at the top and bottom, respectively. These notches are used to interlock with wood structures at the top and bottom of the basement wall as described below in regard to FIG. 4.

Figure 2:
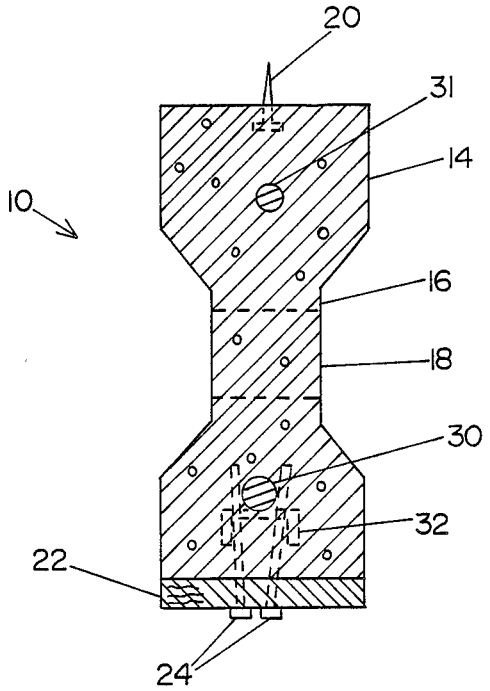
FIG. 2 is a cross section view through section 2—2 on FIG. 1.

FIG. 2 is a horizontal cross section taken through concrete stud 10 at plane 2—2 in FIG. 1. FIG. 2 thus show the thinning down of concrete stud 10 from normal thickness at region 14 to web 16. Hole 18, which passes through web 16 is shown by phantom lines. Wood strip 22 is cast onto one edge of concrete stud 10 and the bond is aided by the use of fasteners 24, which along with staple 32, also serve to locate rod 30 during the casting of the concrete. Fasteners 24 may also be distorted or roughened to encourage adhesion by the concrete. At the opposite edge of concrete stud 10, fastener 20 is cast into concrete stud 10 with its point protruding outward. This is later used to attach insulation and wire mesh to the exterior of the basement wall.

FIG. 2 also shows a typical arrangement for the reinforcing of concrete stud 10. In the arrangement shown, vertical reinforcing rods 30 and 31 are oriented to run the length of concrete stud 10.

Figure 3:
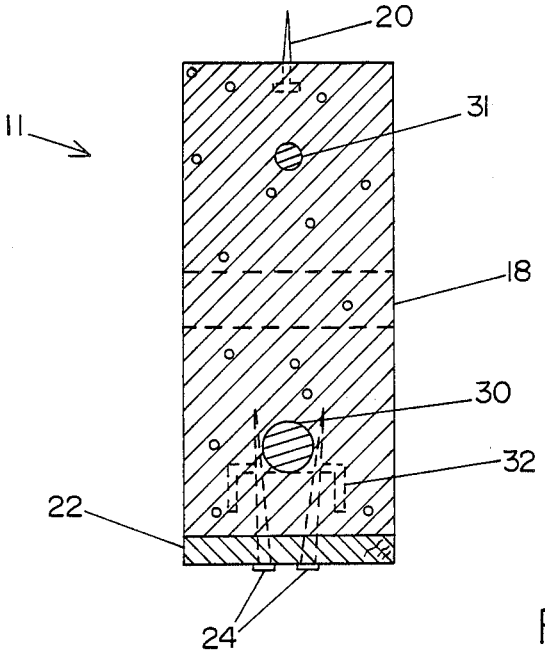
FIG. 3 is an alternate embodiment of a cross section of a stud similar to that of FIG. 2.

FIG. 3 is a cross section view of an alternate embodiment of a stud similar to that of FIG. 1, but without the thinner web. While such a stud is heavier and uses somewhat more concrete material, these disadvantages are somewhat compensated for by the simplicity of the forms needed to cast such rectangular beams. Rectangular concrete stud 11 differs from concrete stud 10 only in its thicker central portion 17. Other features such as wood strip 22 and fasteners 20 and 24 are the same as with concrete stud 10.

Figure 4:
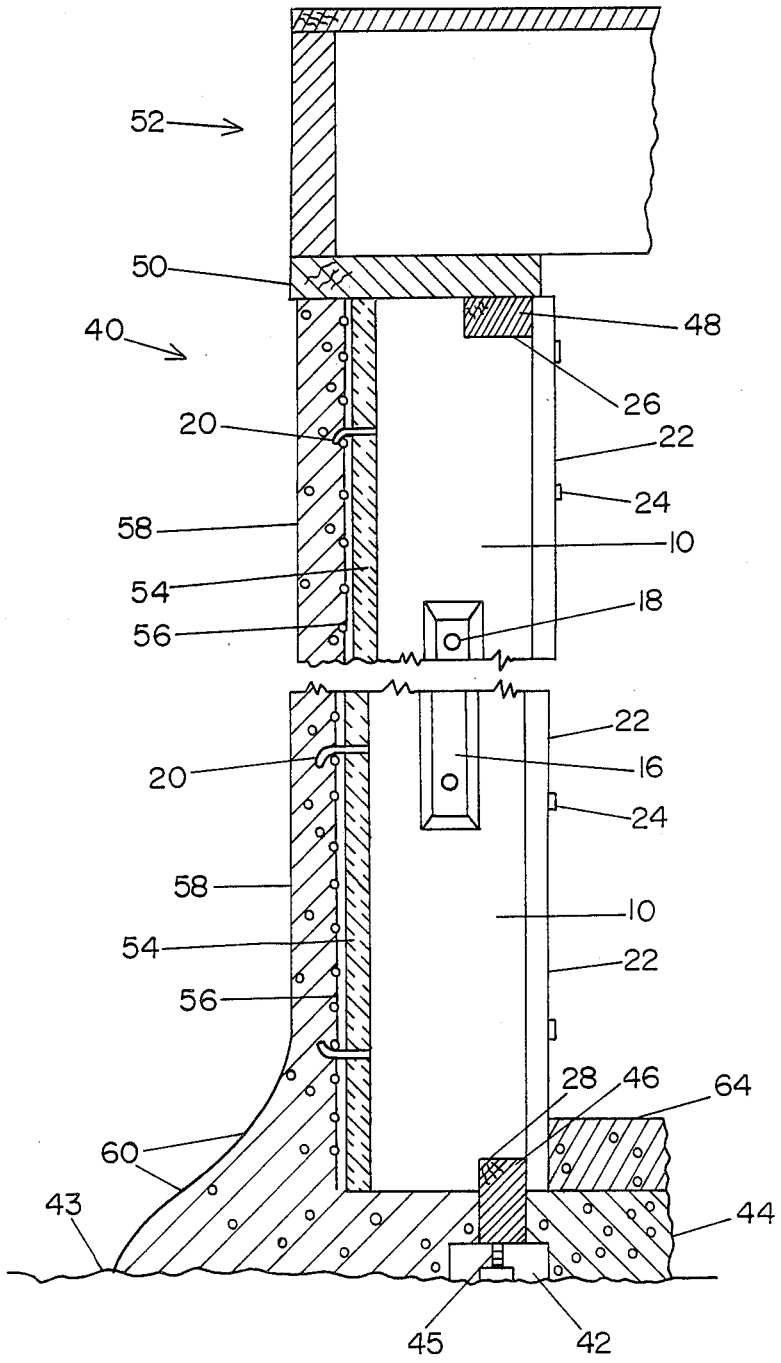
FIG. 4 is a vertical cross section of a baement wall built according to the preferred embodiment of the invention.

FIG. 4 depicts wall 40 constructed according to the teachings of the invention and into which concrete stud 10 is integrated. FIG. 4 is a cross section view in a vertical plane through wall 40, but is foreshortened by use of a break point in the height.

Wall 40 is constructed by first laying several bricks 42 spaced apart to support pressure treated wood beam 46 so that notch 28 and wood strip 22 contact wood stud 46, and wood strip 22 is nailed to wood beam 46 with conventional nails (not shown). Several concrete studs are placed along wall 40 in this manner at an appropriate spacing, typicaly two feet apart, and then dubble plate 48 is set into notch 26 at the top of all the concrete studs 10, and wood strip 22 is also nailed to dubble plate 48. Top plate 50 and floor assembly 52 are then attached to dubble plate 48 by conventional construction techniques.

The exterior of wall 40 is constructed by impaling rigid sheath insulation 54 upon fasteners 20 to the thickness of insulation desired, hanging wire mesh 56 on fasteners 20, and then bending fasteners 20 to capture both wire mesh 56 and insulation 54.

Concrete surface 58 is then sprayed onto insulation 54 and wire mesh 56 by standard techniques of high velocity concrete spraying. Several machines are currently marketed for such spraying. The concrete spray is, however, directed so as to form the vertical portions of wall 40, but is also sprayed to cover a monolithic footer and a waterproof seal area 60 around the junction between wall 40 and bricks 42 and earth base 43 upon which they sit.

Finally, concrete basement floor 64 is poured inside the basement on top of stone base 44 to a depth sufficient to lock concrete studs 10 and wood studs 46 in place to complete a particularly strong and waterproof wall.

In order to assure that wall 40 is properly level and plumb, it is, at various stages prior to the concrete spraying, adjusted for leveling and proper vertical orientation by use of leveling legs 45 previously attached to base beam 28. Also, after completion as described above, interior finishing can be accomplished by attaching paneling or plasterboard to wall 40 by use of conventional nails or other fasteners onto wood strip 22.

Figure 5:
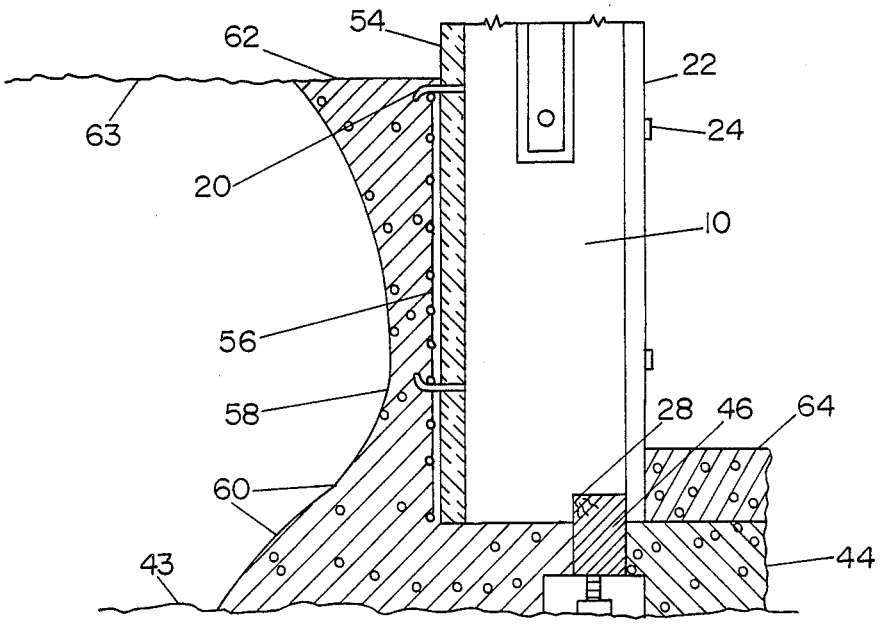
FIG. 5 is a partial cross section of a basement wall showing a shelf for supporting exterior brick facing.

FIG. 5 is a partial cross section similar to the lower portion of FIG. 4 but showing shelf 62 formed by excess thickness of concrete spray. Shelf 62 is used to support an exterior brick veneer (not shown) in structures which are partially above ground level 63, and therefore no concrete need by sprayed above the shelf.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the base beam and dubble plate can be any size lumber, preferrably of standard dimension, and the notches at the top and bottom of the concrete beam are then cast to match the size of the lumber to be used.

What is claimed as new and desired to be secured by Letters Patent of the United States is:

1. A wall structure comprising:

a base beam located in essentially a horizontal plane and sitting upon an underlying support for the wall;

concrete studs, their lengths oriented vertically and their bottom ends attached to and spaced along the base beam, each concrete stud including a strip attached to its edge which is on the inside surface of the wall structure and fasteners attached to the edge which is on the outside surface of the wall structure;

a top plate, attached to the top ends of the concrete studs, located in an essentially horizontal plane;

insulation attached to the outside edge of the concrete studs by the fasteners attached to the outside edges of the concrete studs;

reinforcement means located on the outside surface of the insulation and attached to the insulation and the concrete studs by the fasteners attached to the outside edges of the concrete studs; and a layer of concrete attached to the surface formed by the reinforcement means and the insulation, the concrete enclosing the reinforcement means and the insulation.

2. The wall structure of claim 1 further comprising a concrete floor layer covering the underlying support for the wall on the inside of the wall and extending up along the height of the wall, covering the base beam and a portion of the concrete studs and locking the wall structure in place and together.

3. The wall structure of claim 1, wherein the layer of concrete covers essentially the entire exterior wall surface.

4. The wall structure of claim 1 wherein the layer of concrete covers and extends beyond the junction between the concrete studs and base beam and the underlying support for the wall.

5. The wall structure of claim 1 further comprising a shelf formed on the outside surface of the wall by increased thickness of the concrete layer at a selected height on the outside surface of the wall.

6. The wall structure of claim 1 wherein the concrete studs include through holes across their thickness, the holes being oriented essentially parallel to the plane of the wall.

7. The wall structure of claim 1 wherein the concrete studs include notches cast into the bottom ends, the notches matching the cross section of the base beam so that the concrete studs interlock with the base beam.

8. The wall structure of claim 1 wherein the concrete studs include notches cast into the top ends, the notches matching the cross section of the top plate so that the concrete studs interlock with the top plate.

9. The wall structure of claim 1 wherein the strips attached to the concrete studs extend along the length far enough so that the strip contacts the base beam and top plate, and the concrete stud is attached to the base beam and top plate, by attaching the strip to the base beam and top plate.

10. The wall structure of claim 1 wherein the concrete stud is of essentially rectangular cross section.

11. The wall structure of claim 1 wherein the concrete stud includes a central web of lesser thickness than the end regions of the concrete stud.

12. The wall structure of claim 1 wherein the base beam and the top plate are constructed of wood.

13. The wall structure of claim 1 wherein the strip is attached to the concrete stud by fasteners cast into the concrete beam.

14. The wall structure of claim 1 wherein the fasteners on the outside edge of the concrete stud are attached to it by being cast within it.

15. The wall structure of claim 1 wherein the fasteners on the outside edge of the concrete stud have sharpened points and are cast into the concrete stud with the points extending out of the concrete stud.

16. The wall structure of claim 1 wherein the insulation is rigid sheet insulation.

17. The wall structure of claim 1 wherein the concrete layer is attached to the surface formed by the reinforcing means and insulation by spraying the concrete directly onto the surface.

18. The wall structure of claim 1 wherein the concrete studs further include reinforcing means.

19. The wall structure of claim 1 wherein the concrete studs further include steel reinforcing rods oriented along the length of the concrete stud.

20. A structural member for walls comprising a reinforced concrete stud with an attachment strip cast onto one edge of the concrete stud and with fasteners for attaching sheet material cast into the other edge of the concrete stud.

21. The structural member of claim 20 further including a thinner centrally located web.

22. The structural member of claim 20 further including through holes across its thickness.

23. The structural member of claim 20 wherein the cross section of the concrete stud is essentially rectangular.

24. The structural member of claim 20 wherein the attachment of the strip is aided by fasteners cast into the concrete stud.

25. The structural member of claim 20 wherein the fasteners for attaching sheet material comprise sharpened points protruding from the concrete stud.

26. A method of constructing a wall structure comprising:

laying a horizontal base beam on a suitable base layer;

attaching reinforced concrete studs, extending essentially vertically upward, at intervals along the base beam;

attaching a top plate to the tops of the concrete studs;

attaching insulation to the edges of the concrete studs which are at the outside of the wall structure;

attaching wire mesh to the insulation on the insulation surface opposite from the concrete studs; and spraying concrete onto the surface formed by the wire mesh and insulation to form a layer which covers the exterior wall surface.

27. A method of constructing a wall structure as in claim 26 further including extending the spraying of concrete to cover and extend beyond the junctions between the concrete studs and the base beam and the base layer.

28. The method of constructing a wall structure as in claim 26 further comprising laying a concrete layer on the base layer on the inside of the wall structure to cover the base beam and a portion of the concrete studs to lock the wall structure in place and together.

* * * * *